US005993093A

United States Patent [19]

Schoennauer et al.

[11] Patent Number: 5,993,093

[45] Date of Patent: Nov. 30, 1999

[54] PRINTER

[76] Inventors: Larry Joseph Schoennauer, 644 Laura Way, Paso Robles, Calif. 93446; David Stuart Hollstein, 1481 Whippoorwill La., Templeton, Calif. 93465; Russel Hugh Marvin, 45 Upper Wedgewood La., Voorheesville, N.Y. 12186; Auston C. Candee, 7575 Airport Rd., Paso Robles, Calif. 93446; Dean O'Brien Miller, 8395 Settlers Pl., Paso Robles, Calif. 93446

[21] Appl. No.: 08/963,916

[22] Filed: Nov. 4, 1997

[51] Int. Cl.[6] ..... B41J 11/70

[52] U.S. Cl. ..... 400/621; 400/613

[58] Field of Search ..... 400/621, 621.1, 400/613, 693; 101/224, 226, 227; 346/24; 83/564

[56] References Cited

U.S. PATENT DOCUMENTS

| | | | |
|---|---|---|---|
| 4,907,014 | 3/1990 | Tzeng et al. | 346/24 |
| 5,062,722 | 11/1991 | Shiozaki et al. | 400/621 |
| 5,816,720 | 10/1998 | Brannan et al. | 400/621 |

FOREIGN PATENT DOCUMENTS

| | | | |
|---|---|---|---|
| 62-74672 | 4/1987 | Japan | 400/621 |
| 63-205264 | 8/1988 | Japan | 400/621 |
| 5-147285 | 6/1993 | Japan | 400/621 |

*Primary Examiner*—Christopher A. Bennett

[57] ABSTRACT

A clamshell style printing apparatus for printing on print media, including linerless media, and a method for controlling a printing apparatus. The printing apparatus includes a main circuit board assembly located within a printer housing member that mounts relatively low speed electronic components, and which includes a dual-sided circuit board. A control board assembly is electronically coupled to the main board assembly via a SIMM connector and mounts relatively high speed electronic components, such as a microprocessor, RAM, ROM, system clock and Ethernet controller. The printer apparatus defines a print media path that extends from a print media supply to a cutting mechanism and includes a subassembly for mounting the printhead and a rotary cutter element that is movable between opened and closed positions. An alignment mechanism maintains alignment of stationary and rotary cutter members when the subassembly is moved to the closed position. A key defining a slot and forming part of the subassembly is engageable with the pin forming part of the stationary cutter member. When adapted to print on linerless media, the printer includes a base member which includes an integral portion defining a recess for a platen roller and a portion defining a guide plate for guiding a leading end of the print media from the printing station to a cutting station. The portions are covered with a release coating, such as a plasma coating or Teflon®. To further reduce sticking of media to printer components, the rotary cutter element is Teflon® coated. The control system includes sequences for unjamming the printer or to inhibit operation of components, such as the cutter in the event print media has been improperly fed.

8 Claims, 8 Drawing Sheets

120
120b
176
120a 100
150
154
154a
16
120
110
102
130
124a
136a
124
140
136
18
12'
12
10a

PRINTER

TECHNICAL FIELD

The present invention relates generally to printing and, in particular, to a printing apparatus having reduced electromagnetic emissions and including a clam shell arrangement for facilitating installation of print media, including a cutter having separable components.

BACKGROUND ART

Printers of the type to which this invention pertains have many applications and uses. They may be used as part of a point-of-sale terminal and, in this application, are used to print receipts, etc. Printers of this type may also be used to generate labels on which alphanumeric characters or symbology, i.e., bar codes are printed.

These types of printers often utilize thermal print technology to print indicia on print medium. Thermal printing involves a thermal printhead which uses heating elements to produce localized heating on thermal reactive print medium to produce indicia on the print media. In order to effect the printing process, the print medium must be clamped between a platen and the thermal printhead.

At least some of these printers utilize a rotary cutter to severe the printed, media portion from the media supply. In order to facilitate threading of the print media, it is desirable that the cutter components separate. However, in order for a rotary cutter mechanism to function properly, the components, i.e., the rotary cutter and stationary blade must be maintained in predetermined alignment. This has proved to be difficult in the past when one of the two components is mounted to a subframe that rotates to an open position. If the alignment between the rotary cutter and stationary blade is disturbed as a result of opening and closing the printer, a service call or readjustment is required.

DISCLOSURE OF THE INVENTION

The present invention provides a new and improved printing apparatus and method in which electromagnetic emissions (EMI) are reduced without adding excessive costs to the printer. In addition, the disclosed printerincludes a clam shell feature which facilitates loading of the print media and which includes a cutter mechanism in which a rotary cutter separates from a stationary blade. According to this aspect of the invention, an alignment mechanism is provided such that the rotary cutter and stationary blade are maintained in operative alignment whenever a clam shell portion of the printer is closed i.e. whenever the printer is closed.

According to one aspect of the invention, the printing apparatus includes a main circuit board assembly that is located within a printer housing and which mounts relatively low speed electronic components. A control board assembly, which mounts relatively high speed electronic components is electronically coupled to the main board assembly. In the preferred and illustrated embodiment, a SIMM connector is used to mount the high speed control board assembly to the main board assembly. In one disclosed example, the control board assembly mounts a microprocessor and associated high speed support components, such as RAM, ROM and a system clock. In another disclosed example, the control board assembly also mounts an Ethernet controller and includes cabling and a connector for connecting the control board assembly to an Ethernet network.

According to another aspect of the invention, the clamshell portion of the printer includes a subassembly or subframe that mounts a thermal printhead and a rotary cutter element. When the subassembly is closed, alignment keys forming part of the subassembly engage alignment pins forming part of a stationary cutter member. The engagement assures alignment of the stationary member with the rotary member.

According to this aspect of the invention, the mounting of the thermal Printhead and rotary cutter element in the subassembly facilitates loading of print media into the printer. When the subassembly is moved to the open position, the thermal printhead and the rotary cutter element are moved a spaced distance from the associated platen roller and stationary blade, respectively, which are mounted in a base portion of the printer.

An embodiment of the printer is also disclosed which is adapted to handle "linerless" print media. Those skilled in the art will recognize "linerless" print media to include adhesive backed material which does not include a liner or release strip. As the print media unwinds from a supply roll, an adhesive side of the media is exposed and does contact components of the printer as it proceeds along the paper path. In accordance with this embodiment, a base member is disclosed which serves as a structural member for the printer, but which also includes a portion defining a platen roller recess and a print media guide plate located intermediate the platen roller and a cutting station. In the preferred and illustrated embodiment, the entire base member includes a release coating which may be a plasma coating or a Teflon® based coating.

In accordance with a further aspect of this feature, a control system is disclosed which advances a lead end of the print media a predetermined distance beyond the print station, if printing on the print media does not commence within a predetermined interval of time, i.e., five seconds. The print media is then retracted prior to commencement of printing, so that Printing can commence at a leading edge of the print media.

The control system also includes unjam operational sequences. In one sequence, a home position of the rotary cutter element is monitored. In the event that the rotary cutter does not return to the home position within a predetermined interval of time after initiating a cut sequence, the rotary cutter element is reverse actuated in an effort to return it to the home position.

According to this feature of the invention, a print media detector located at a discharge end of the printer is used to detect the presence of print media at the discharge end. If the presence of media is not detected prior to initiation of the cutting cycle, the cutting cycle is inhibited.

An unjam sequence is also disclosed which enables an operator to effect repositioning of the rotary cutter element to expose a side that is inaccessible during normal operation.

To further reduce incidence of jams or to improve removal of jammed media, the rotary cutter element may be coated with a release coating, such as Teflon®.

Additional features of the invention will become apparent and a fuller understanding obtained by reading the following detailed description made in connection with the accompanying drawings.

BEST MODE FOR CARRYING OUT THE INVENTION

Figure 1:
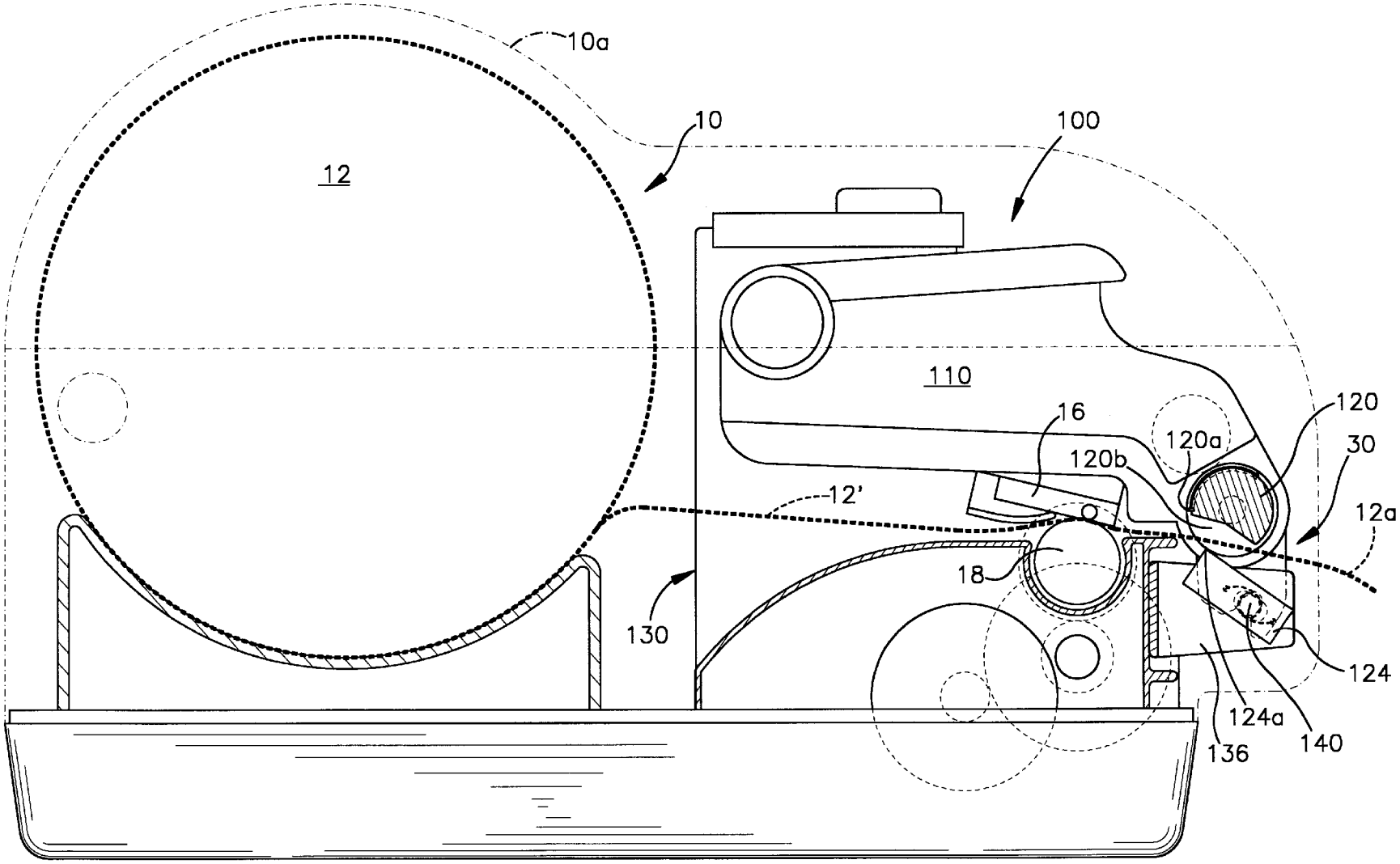
FIG. 1 is a side elevational view partially in section, showing a printer constructed in accordance with the preferred embodiment of the invention.

FIG. 1 illustrates the overall construction of printer embodying features of the present invention. For purposes of explanation, the present invention will be described in connection with a thermal-type printer. The disclosed printer may be used to print receipts, tickets, labels, etc. However, it should be understood that the principles of the invention are applicable to other types of printers and printing mechanisms including, but not limited to, dot matrix printers, ink jet printers and laser printers.

The printer illustrated in FIG. 1, includes a compartment 10 enclosed by a moveable cover 10*a* in which a print media supply is located. In the illustrated embodiment, the print media supply comprises a roll of print media 12. Indicia on the print media is printed by a thermal printhead 16. As is conventional, a lead end 12' of the print media passes between the thermal printhead and a platen roller 18. Heating elements in the thermal printhead are selectively energized in order to produce indicia or symbology on the thermal reactive print media as it passes between the thermal head and the platen roller.

The illustrated printer includes a cutting mechanism indicated generally by the reference character 30 which severs a printed receipt, label, etc. after it is printed (indicated by the reference character 12*a*.

Figure 2:
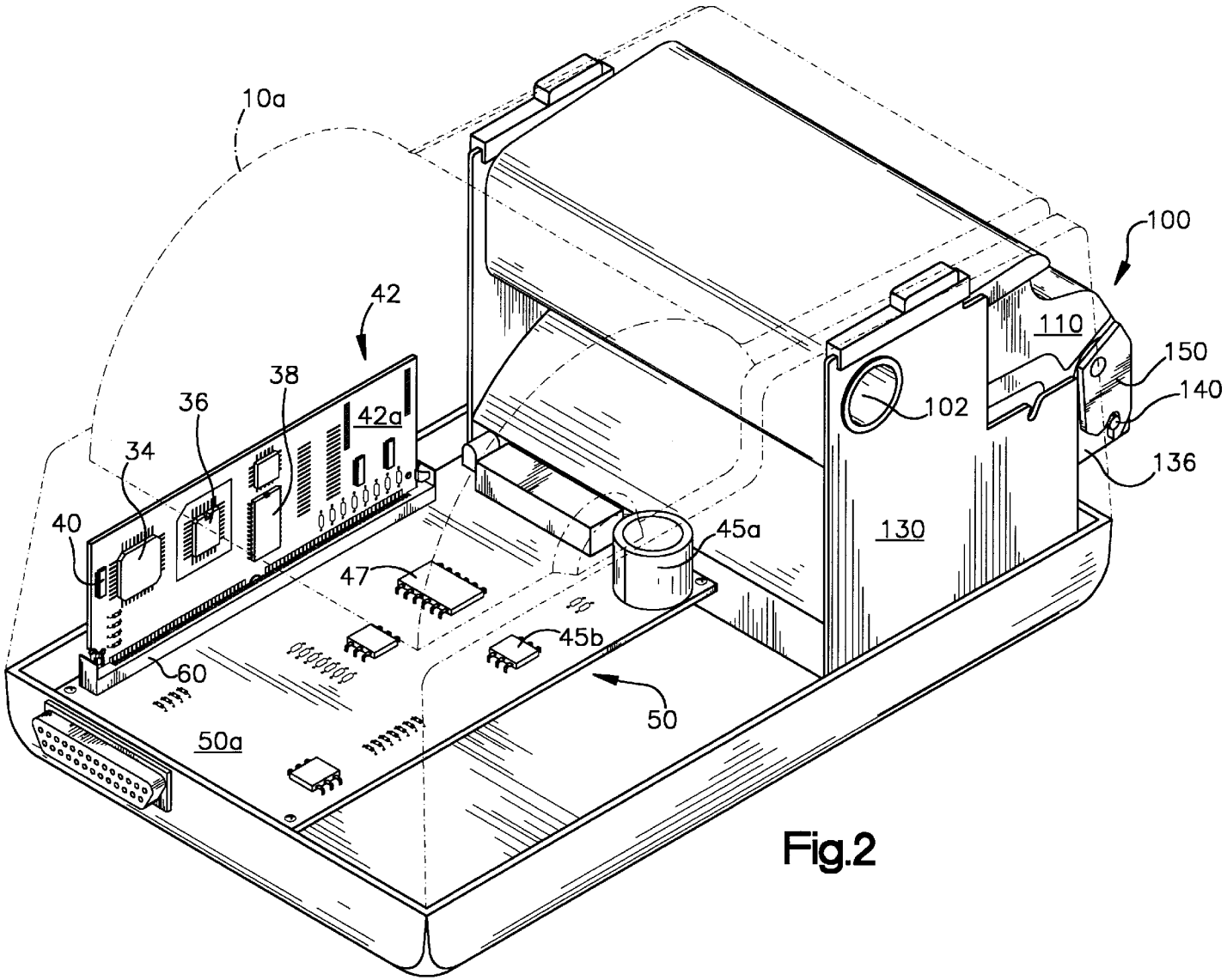
FIG. 2 illustrates a main board and daughter board forming part of the printer.
Figure 3:
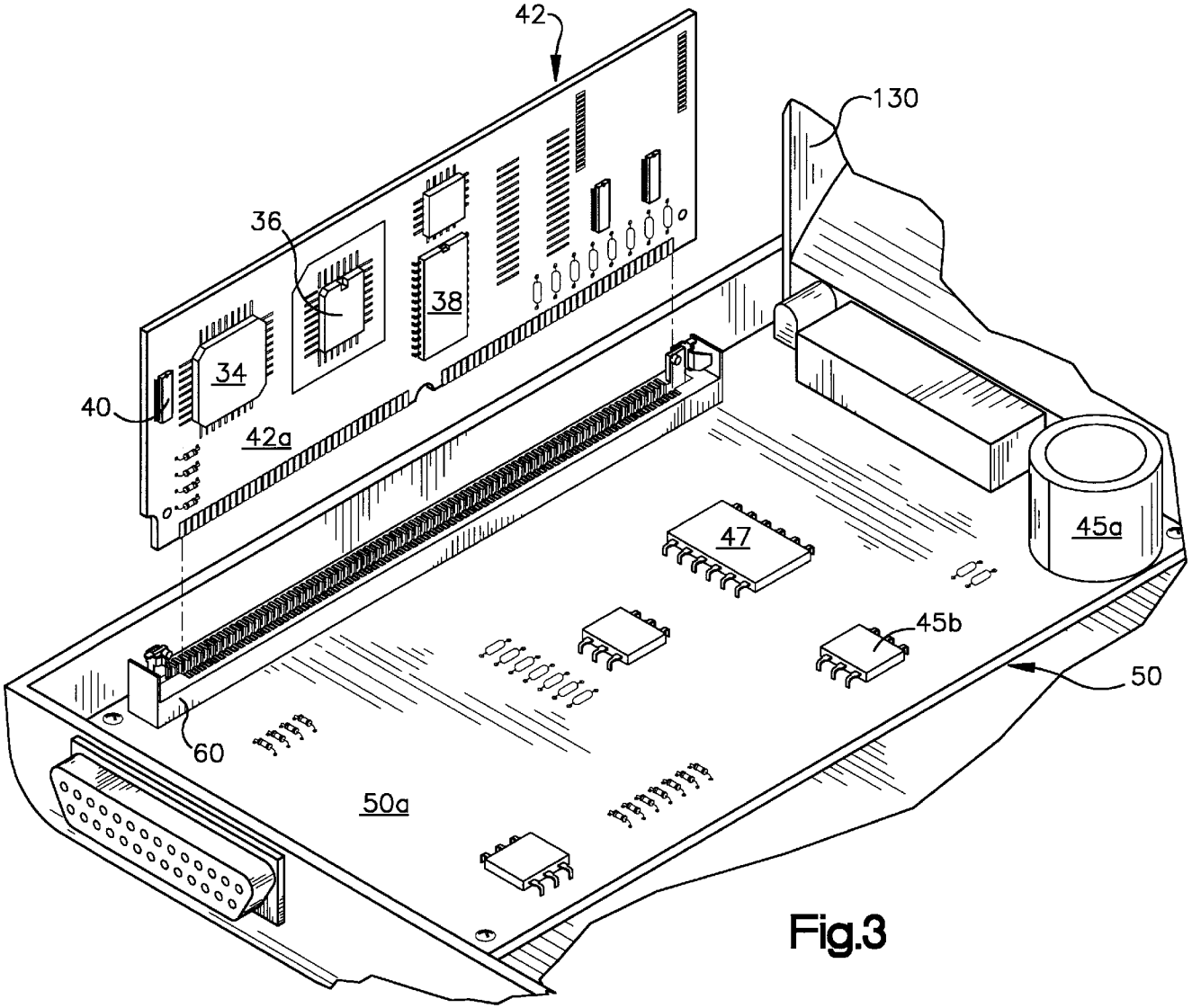
FIG. 3 is an enlarged perspective view of the main board and daughter board, showing the connector interface between the two boards.

Turning first to FIGS. 2 and 3, the disclosed printer includes an arrangement of circuit board assemblies which minimizes or reduces the electromagnetic radiation often termed "EMI" of the printer. According to the invention, high speed control components which typically comprise a microprocessor 34 and associated support components such as ROM 36, RAM 38 and system clock 40 are mounted to a multi-layer board 42*a* forming part of a control board assembly 42 that plugs into a main board assembly 50 to which only low speed components are carried. The low speed components may include drive components for the thermal printhead, components 45*a*, 45*b* that form part of the power supply, motor drive components 47 for the cutter and/or media advancing mechanism, components associated with sensors, and components needed for interfacing input and output connections between the printer and peripheral devices. These low speed components may be analog devices or devices which produce relatively low frequencies as compared to the frequencies generated by the microprocessor and its associated components, i.e., system clock, RAM, ROM, etc. For purposes of this application and considering the spectral content of a signal, low speed signals are signals that generally have little energy content at frequencies above 30 MHz. High speed signals have a larger proportion of their energy above 30 mhz.

According to the invention, the main or base circuit board 50*a* is a relatively inexpensive construction, such as a single sided or two sided printed circuit board. The control board 42*a*, on the other hand, would be a multi-layer board and in the illustrated embodiment, comprises a four layer board. As is known, multi-layer boards inherently have reduced EMI because at least one layer of the board constitutes a "ground plane". Multi-layer boards, however, are expensive to fabricate, as opposed to single and dual-sided circuit boards.

According to the invention, the expensive, multi-layer board construction is used only for the high speed digital components. As seen in FIG. 1, the multi-layer board 42*a* mounts, for example, the microprocessor 34, its associated ROM and RAM chips 36, 38, a clock module 40 and other high speed support componentry needed for proper operation of the microprocessor 34. Virtually all of the low speed componentry that is driven or controlled by the microprocessor control circuit is mounted to the relatively inexpensive single sided or dual sided circuit board 50*a*.

In the preferred embodiment, the multi-layer microprocessor control board 42 is configured as a "daughter board" that is interfaced to the main board 50 by a conventional single in line memory module (SIMM) 60. In the illustrated embodiment, a conventional 72 SIMM connector is used. It should be understood, however, that the size of the SIMM connector is determined by the number of connections that must be made between the microprocessor control board 42 and the main board 50. Accordingly, other size SIMM connectors such as 30 pin, 68 pin, 144 pin, etc. are all contemplated by this aspect of the invention.

Using a conventional SIMM connector provides an inexpensive method for providing a connector for mounting the microprocessor control board assembly 42 and also provides a means by which the board assembly 42 can be easily replaced or changed.

According to the invention, only low speed circuits are coupled from the microprocessor control board assembly 42 to the main board assembly 50. High speed circuits such as data bus lines are not communicated across the SIMM connector. To achieve this feature, control commands and functions are communicated directly from microprocessor ports to the main board 50. Commands transmitted to the main board from the microprocessor ports are relatively low speed transmissions, as compared to speeds at which the microprocessor executes instructions or transmits address information along its data bus. As a result, all high speed functions and communications occur only on the multi-layer microprocessor control board 42 and are not transmitted across the SIMM connector 60. With the disclosed board arrangement, EMI is substantially reduced since the components that normally produce EMI are all located on the multi-layer board 42 which, due to its ground plane layer, has substantially reduced EMI.

The disclosed circuit board arrangement provides another feature of the invention. By a modularizing the main control circuitry, alternative control boards can be made available for the printer. For customers requiring sophisticated printing capability, high performance microprocessors and associated circuitry mounted to the board 42 can be provided to support the required application. For applications not requiring high performance or all the functions that the printer is capable of performing, lower cost microprocessor based control boards having less sophisticated microprocessors can be provided. Finally, for those applications that do not require the performance of a microprocessor, extremely low cost control boards containing dedicated control components can be utilized and installed without substantially changing the configuration of the base circuit board assembly 50. In addition, the control board assembly 42 can be easily replaced in the field and even upgraded should a customer desire additional functions or capabilities after purchasing or acquiring the printer.

With the disclosed printer board configuration, extremely cost efficient circuit board construction can be utilized while reducing the overall EMI of the printer. The main board with its associated low speed componentry may take advantage of less expensive manufacturing methods utilizing single or dual sided boards. Only the high speed components which are mounted to the relatively small, daughter-like boards, involve the expense of a multi-layer circuit board.

Figure 11:
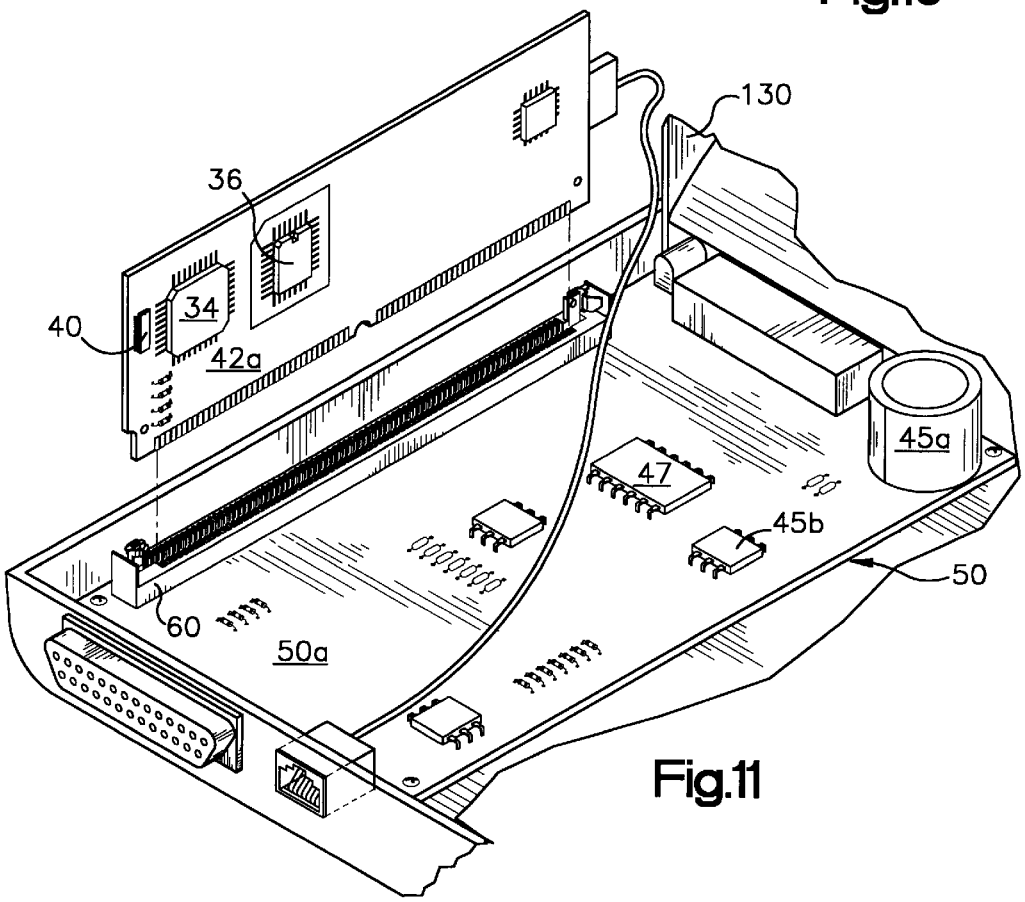
FIG. 11 shows another embodiment of a daughter board that may form part of the printer apparatus; and, FIG. 12 is a block diagram showing the operational sequence that forms part of an unjam feature of the disclosed printer.

FIG. 11 illustrates another example of a control board 42' that can be substituted for the control board 42 shown in FIG. 3. The control board 42' shown in FIG. 11 includes Ethernet capability so that the printer can form a note on a network. In this application, the control board 42' includes a dedicated microprocessor 34', a Ram module 36 and an Ethernet controller chip 43. The Ethernet chip 43 may be a DP 83902 Ethernet Controller I.C. which is available from National Semiconductor. The board 42' includes an interface 45 to which a standard RJ45 connector and associated cable 47*a*, 47*b* are attached. Those skilled in the art will recognize that the RJ 45 connector enables the printer to be connected to a 10 BASE-T Ethernet network. As indicated above, with the disclosed invention, additional features and functions can be added to the printer merely by replacing the control board 42. In this instance, Ethernet network capability is added to the printer by the substitution of the Ethernet control board 42' shown in FIG. 11.

Figures 4, 4A:
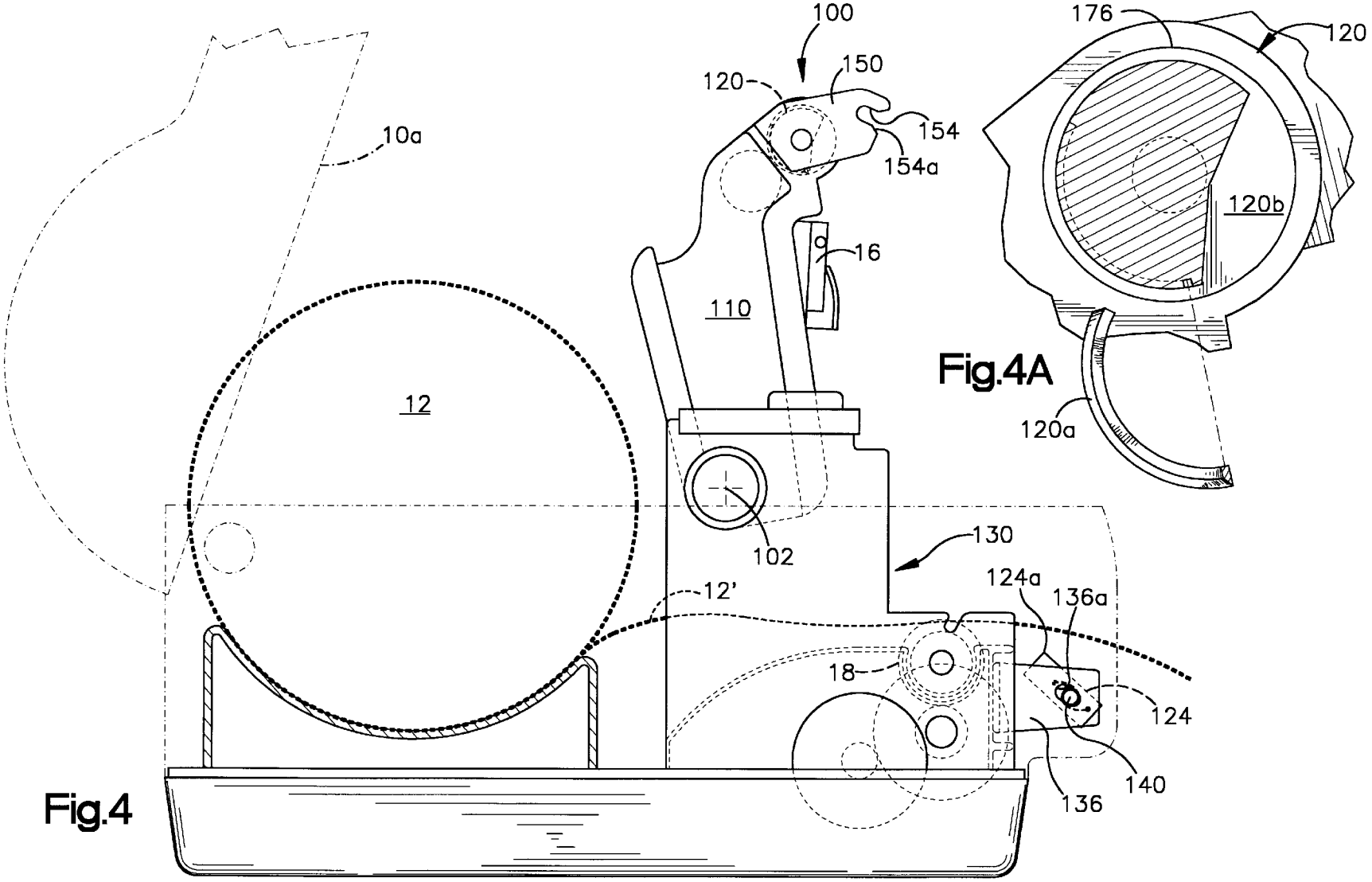
FIG. 4 is another side elevational view of the printer showing open positions of certain components.
FIG. 4A is a fragmentary view of a rotary cutter forming part of the printer.

Referring now to FIGS. 1 and 4–9, the disclosed printer is of a "clam shell" design and includes a paper path subassembly 100 which is pivotally movable between a closed position (shown in FIG. 1) and an open position (shown in FIG. 4). The subassembly 100 is rotated to its open position to facilitate threading of the print media through and along the paper path.

Figure 6:
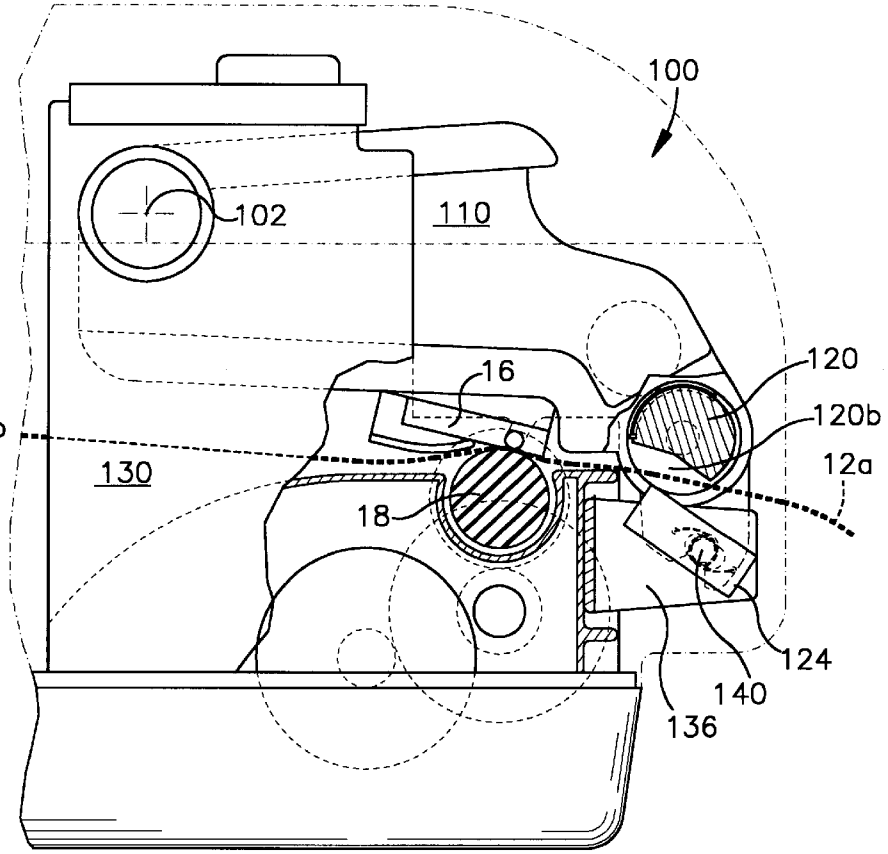
FIG. 6 is a fragmentary view showing a closed position of the components shown in FIG. 5.
Figure 5:
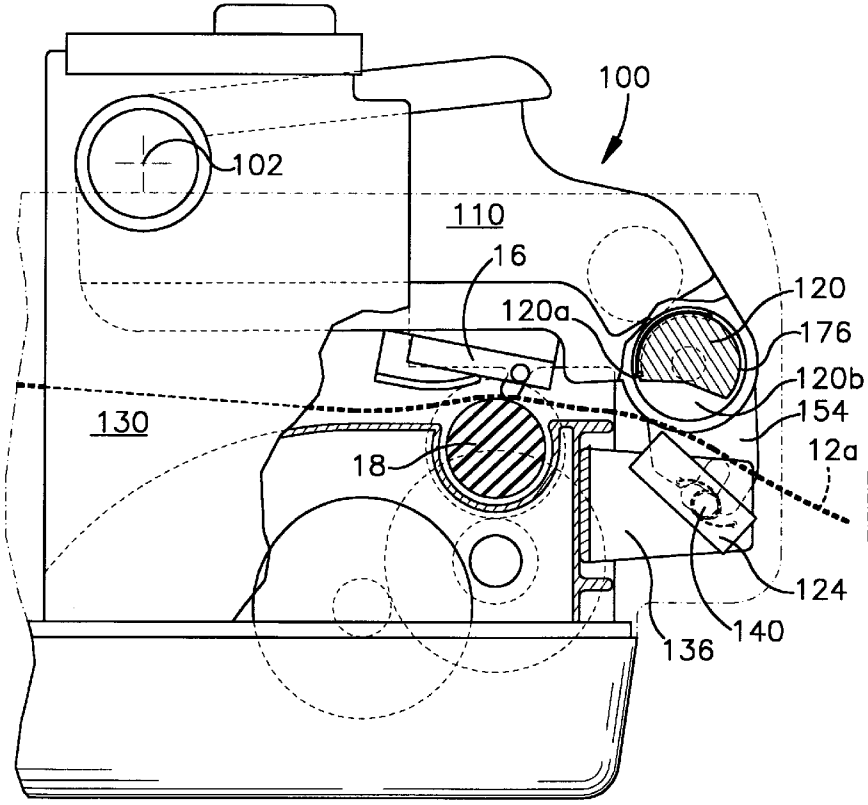
FIG. 5 is a fragmentary view showing a partially open position of certain components.

The paper path subassembly 100 is rotatable about an axis 102 which may be defined by conventional shafts/bearing elements. The subassembly 100 includes a subframe 110 to which the thermal printhead 16 is mounted. The cutter mechanism indicated by the reference character 30 in FIG. 1, is comprised of a rotating cutter member 120 carried in the subframe 110 and a stationary blade 124 carried in a fixed subframe 130 that is mounted to the base of the printer. Thus, in the disclosed construction, the main components 120, 124 that comprise the cutter mechanism 30 separate to facilitate loading of the print media. As seen in FIG. 4, the lead end 12' of the print media 12 is threaded through the stationary subframe 130 and is laid atop the platen roller 18 and fixed blade 124. The moveable subframe 110 is then rotated clockwise to its closed position at which point the leading end 12' of the print media 12 is clamped between the platen roller 18 and the thermal printhead 16 and is positioned between the rotating cutter component 120 and the stationary blade 124. The closed position is illustrated in FIG. 6.

As is known, to ensure proper cutting of the print media, the rotating cutter 120 and the stationary blade 124 must be maintained in a predetermined alignment. This is achieved in the present invention by an alignment mechanism which operates to align the stationary blade 124 with the rotating cutter 120 whenever the movable subframe 110 is rotated to its closed position.

To achieve this feature, the stationary blade 124 is held by the fixed subframe 130 using a pin/slot arrangement. In particular, a pair of bracket elements 136 (only one is shown) extend laterally from the fixed subframe 130. The stationary blade which comprises a rectangular bar includes a pair of pins 140 (only one pin is shown) which extend laterally from each end of the stationary blade. The frame extensions 136 each include a slot 136*a* (only one slot is shown) which is adapted to receive an associated pin 140 forming part of the stationary blade 124. As seen best in FIG. 4, the slot enables the stationary blade to move rectilinearly along a path defined by the slot.

Figure 8:
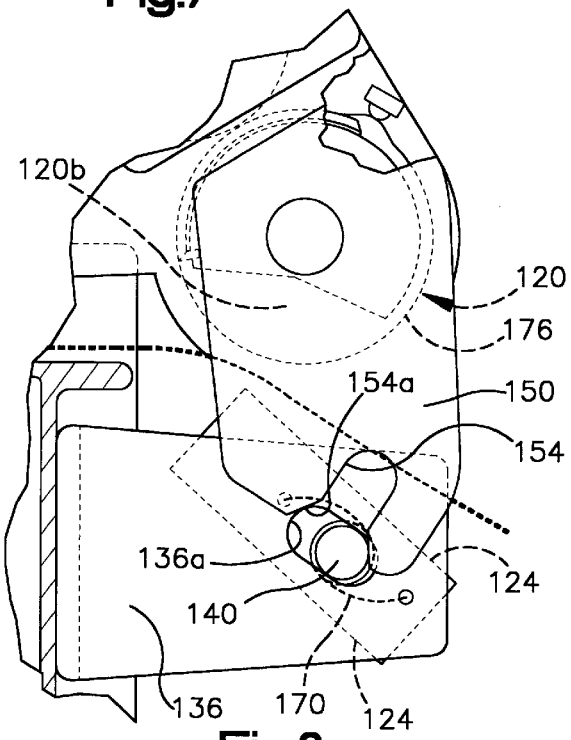
FIG. 8 is an enlarged fragmentary view showing an alignment mechanism for maintaining alignment of a rotary cutter with its associated stationary blade.
Figure 9:
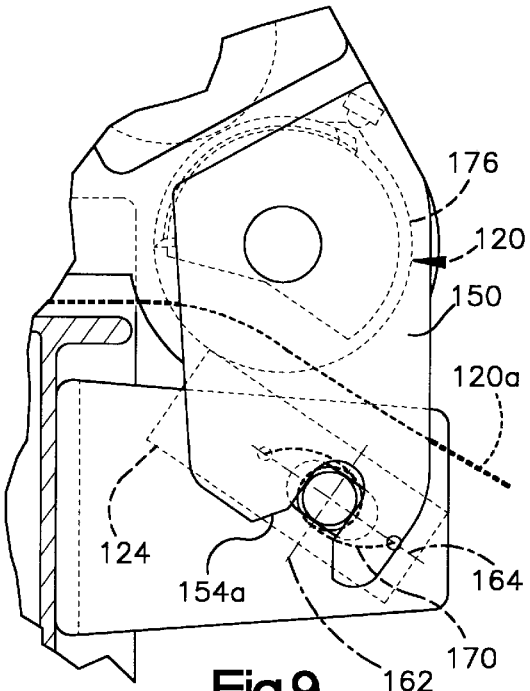
FIG. 9 is an enlarged fragmentary view showing the alignment mechanism in its closed, aligning position.

The moving subframe 110 includes alignment keys 150 (only one of which is shown) which define an open ended slot 154 adapted to receive an associated pin 140. Referring in particular to FIGS. 8 and 9, as the movable subframe 110 moves to its closed position, a camming region 154*a* defined by the slot 154 initially engages the associated pin 140 of the stationary blade 124 The camming region 154*a* cams the pin 140 towards the alignment slot 154. As the movable subframe 110 moves to its fully closed position, the associated pin 140 of the stationary blade 124 enters the alignment slot 154 and is captured therein. Once the pin 140 enters the alignment slot 154, the stationary blade 124 is precisely aligned with the rotating cutter 120. It should be noted that the axis of the alignment slot 154 is preferably perpendicular to the stationary blade locating slot 136*a*, as indicated by the axis lines 162, 164 in FIG. 9. With the disclosed invention, precise adjustments to the stationary blade 124 and the rotary cutter 120 do not have to be made during manufacture. Moreover, readjustments that would ordinarily be required during the life of the printer due to wear and other factors are eliminated because the stationary blade 124 is realigned with the rotating cutter 120 each time the printer cover is closed (which causes the moveable subframe 110 to rotate to its closed position.

As seen best in FIGS. 8 and 9, the stationary blade 124 is biased towards the rotating cutter 120 by a torsion spring 170 mounted to each pin 140 and having one end acting against the blade 124 and the other end acting gainst the bracket extensions 136 that define the slots 136*a* by which the stationary blade pins 140 are held. The torsion springs 170 ensure that the stationary blade 124 is biased into operative contact with the rotary cutter 120 whenever the movable subframe 110 is closed.

To maintain spatial alignment between the rotating cutter 120 and the cutting edge 124*a* (see FIG. 4) of the stationary blade 124, the rotating cutter 120 includes spaced apart hubs 176 which are located at opposite ends of the rotary blade 120 and which ride against the stationary blade 124.

As is conventional, the rotary cutter 120 includes a helical-shaped cutting element 120*a* which performs the cutting action. As is also conventional, the rotary cutter 120 is generally cylindrical, but includes a relieved portion 120*b* located between the circular alignment hubs 176 and through which the print media extends.

Figure 7:
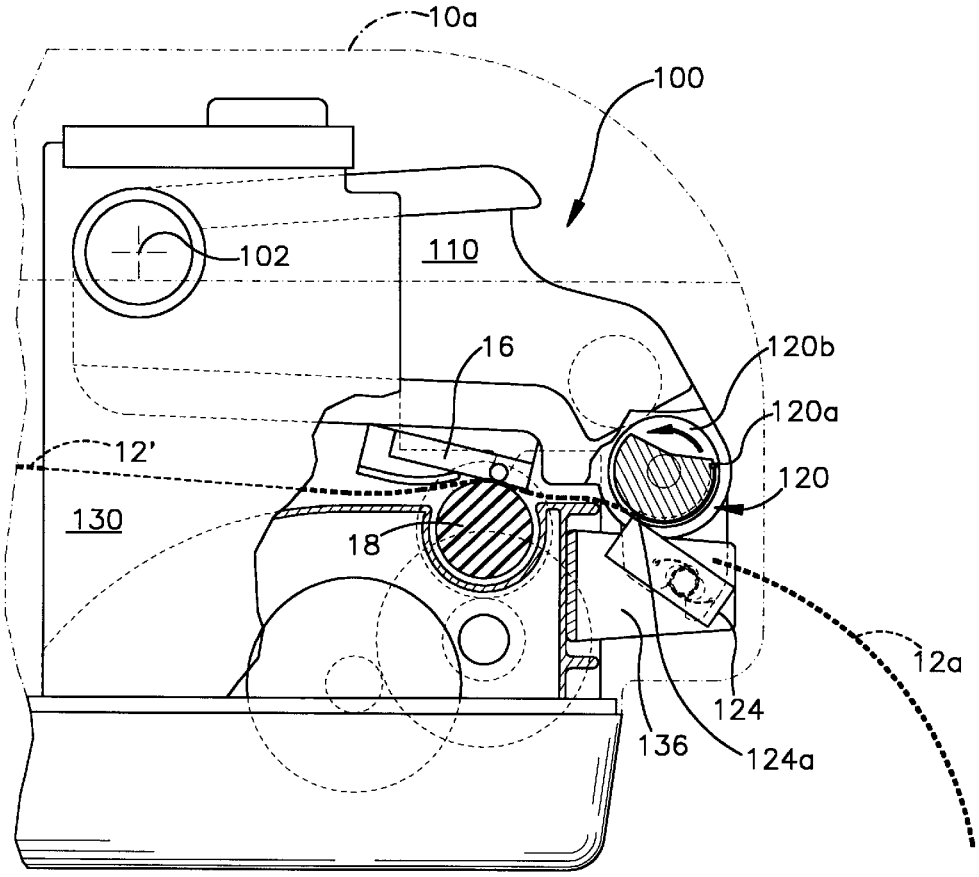
FIG. 7 is a fragmentary view showing operation of a print media cutting mechanism.

To cut the print media at the conclusion of a printing cycle, the rotary cutter 120 is rotated in a counterclockwise direction which causes the cutting element 120*a* to sweep past the cutting edge 124*a* of the stationary blade 124. As it sweeps past the cutting edge 124*a* of the stationary blade 124 a scissor-like action is produced which severs the lead portion 12*a* of the print media from the print media supply 12. The rotation of the cutter 120 which produces severance of the print media is illustrated in FIG. 7.

Figure 10:
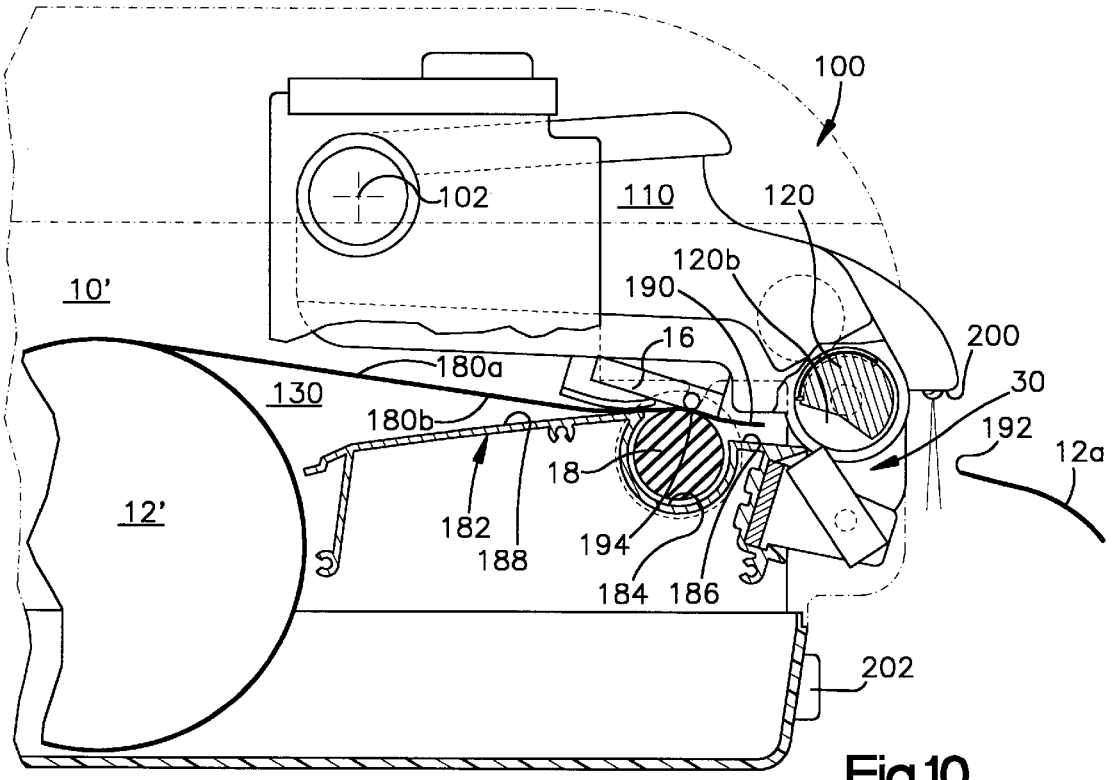
FIG. 10 is a fragmentary view of the printing apparatus showing how it would be used with linerless media.

The disclosed printer is adapted to handle an adhesive back print media known as "linerless" media stock. Those skilled in the art will recognize the term "linerless" media to mean adhesive backed media that does not include a release strip (or "liner) that overlies the adhesive during the printing operation. As seen in FIG. 10, a supply of linerless media 12' having a printing side 180*a* and an adhesive side 180*b* is placed in a supply compartment 10' forming part of the printer. As seen in FIG. 10, the linerless supply roll 12' rotates clockwise as the media is pulled from the roll. As seen in FIG. 1, for conventional media (non-adhesive or liner type media), the supply roll 12 rotates counterclockwise to dispense the media. To facilitate the explanation, the printer will be described in connection with the printing of adhesive backed labels. Accordingly, the media 12 will be referred to as linerless label stock. At the conclusion of a printing and cutting cycle, an adhesive backed label 12*a'* will be produced by the disclosed printer. It should be understood however, that the disclosed apparatus can be used to print a wide variety of media.

According to the preferred embodiment, an extruded base member 182 extends between side plates of the printer and serves as a structural member for the printer. In the preferred embodiment, the base member 182 is extruded aluminum. The base member includes an integral recess 184 which at least partially surrounds the platen roller 18. Also integrally formed in the base member is a guide plate 186 which guides the emerging label towards the cutter 30.

In the preferred embodiment, an entire upper surface 188 of the base member 182 defines a release surface to which sticking of the adhesive backed media is inhibited. In the preferred embodiment, the surface 188 of the base member 182 is coated with a release coating, such as a plasma coating. Plasma coatings suitable for this application are available from Plasma Coatings, Inc. of Memphis, Tenn. Other coatings, such as Teflon® may also be used in some applications. Similarly, the platen roller 18 is made from a material that does not readily adhere to the print media adhesive. Silicon based rubber compounds are known which can be used for this purpose. Other elastomers may also be used. Platen rollers suitable for this application can be obtained from Silicone Products And Technology, Inc. Of Lancaster, N. Y.

As indicated above, the upper surface 188 of the base member 182 is coated with a release coating. In the preferred embodiment the entire upper surface, including the surface of the recess 184 that confronts the platen roll 18, as well as the upper surface of the guide plate 186, are all coated with a release coating.

By integrating the platen recess and guide plate into one unitary component, manufacturing costs are reduced since, it is much simpler to coat one component with a release coating, rather than individual components. In addition, manufacturing costs are reduced because the component 182 not only provides a guide surface for the ejected label, but also serves as a structural component for the printer. By incorporating the platen recess in the base member, the surface that confronts the roll also includes a release coating. In the event that the web wraps around the platen roller, it can be readily removed from the recess.

According to a feature of the invention, the printer includes an operating cycle which reduces the risk of the leading edge 190 of the print media adhering to the platen roller. In the preferred embodiment, the printer operates as follows. Following the end of a printing cycle, the print media is advanced until a rear edge 192 (the rear edge 192 is indicated on a severed label 12*a'*) of a just printed label is aligned with the cutter 30. The cutter is then actuated to sever the printed label 12*a'* from the rest of the supply 12. Following the cutting cycle, the print media is retracted so that the leading edge of the print media is aligned with the printing line (indicated generally by the reference character 194) of the printhead 16. By retracting the print media, printing can commence at the leading edge of the media. If printing is not initiated within a predetermined interval of time, such as five seconds, the print media is advanced so that the leading edge 190 extends a predetermined distance beyond the printhead/platen roller contact line as shown in FIG. 10. When a printing cycle is about to be initiated, the label is again retracted to align the leading edge with the print line 194 on the printhead. In this way, the tendency for the leading edge of the print media to follow the platen roller causing a jam or misfeed, is reduced.

The disclosed printer also includes an operational sequence which can be initiated by an operator to facilitate the removal of a misfeed or jam. The printer also includes operational sequences which are intended to recognize the presence of a jam and inhibit further operation.

Referring to FIG. 10, the printer preferably includes a label sensor 200 located at the label discharge opening of the printer. In addition, a form feed button 202 preferably located in the base, forms part of the printer. A "form feed" button is commonly used by an operator to advance print media a predetermined distance, typically the length of a "form", in this case a label.

The sensor 200 serves two purposes. Firstly, when a label has been printed and then severed by the cutter 30, it is normally still held in the discharge opening and is ultimately pulled out by an operator. The sensor 200, as one function, detects that the operator has removed the just printed label.

The printer also preferably includes means for detecting a jam involving the cutter mechanism. Referring also to FIGS. 8 and 9, the position of the rotary cutter 120 is monitored by a cutter sensor which, in the preferred embodiment, comprises a microswitch 210 (shown in FIGS. 8 and 9) which is actuated by a cam surface 212 forming part of the rotary cutter element 120. The sensor 210 is intended to detect the "Home" or initial position of the rotary cutter 120. During a cutting cycle, the control system of the printer monitors the state of the "Home" detector switch 210. If, after initiating a cut cycle, the rotary cutter element 120 does not return to the Home position within a predetermined time interval, further operation of the printer is inhibited because the system assumes that a jam has occurred. In one embodiment, the failure of the rotary cutter element to return to the Home position (as detected by the microswitch 210) causes the control system to attempt to reverse rotate the rotary cutter 120 in an effort to return it to the Home position.

In addition, the label detector sensor 200 is monitored during the advancement of the label following the end of the printing cycle. If the leading edge 190 of a just printed label is not detected within a predetermined interval of time following commencement of print media advancement, the system inhibits further operation of the printer, including the cutting cycle until the operator takes corrective action.

In the preferred embodiment, release coatings may be applied to the cutting mechanism 30 to reduce potential jams or to facilitates the removal of a jam should one occur. In particular, the rotary cutting element 120 may be coated (except for the cutting edge 120*a*) with Teflone®.

Figure 12:
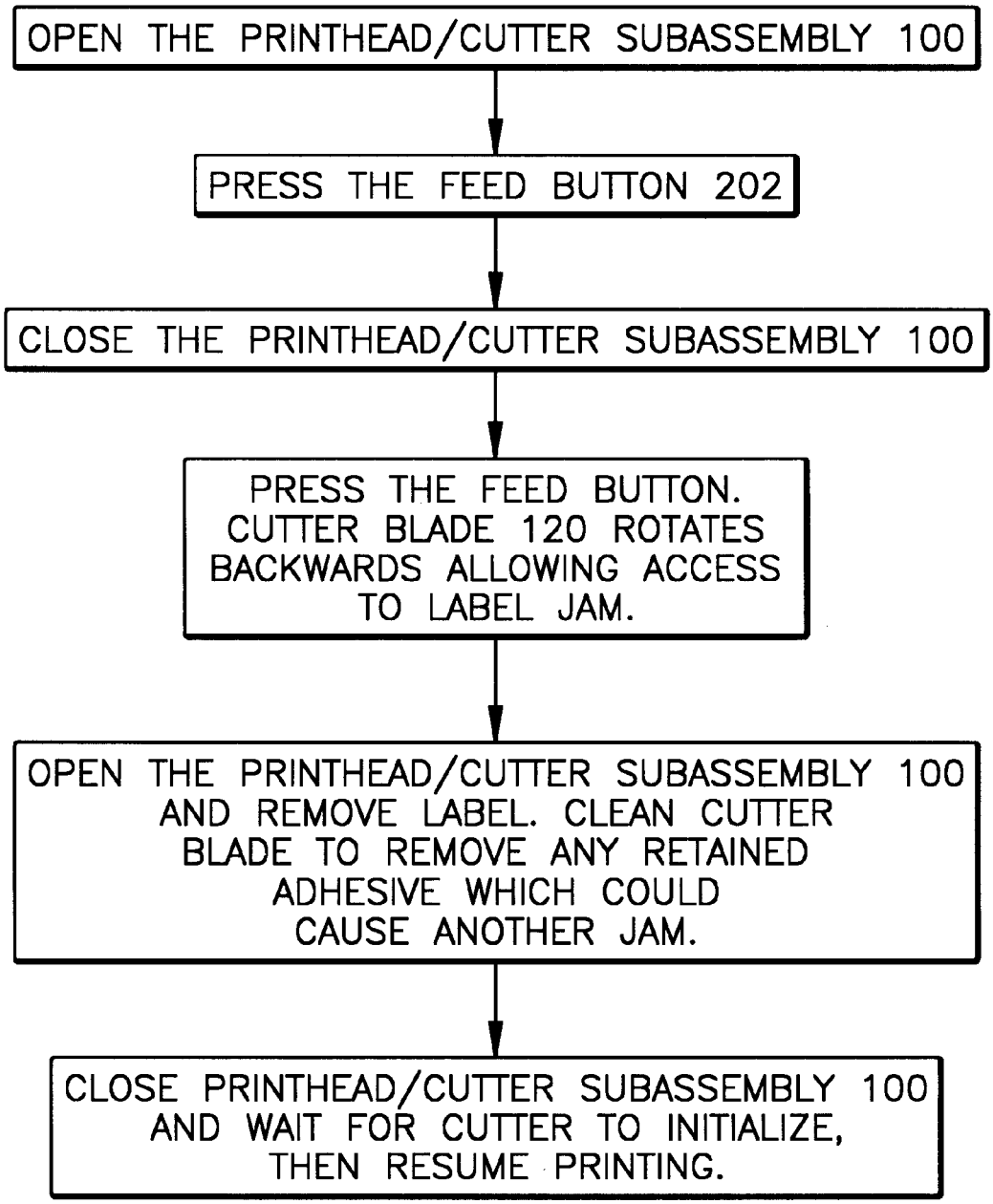

Referring also to FIG. 12, the control system of the printer includes an unjam sequence that can be initiated by the operator. As part of the unjam sequence, the rotary cutter element 120 is rotated 180° which enables the operator to remove a label that may have been wrapped around the cutter element 120. The sequence operates as follows. The operator opens the printer, i.e., rotates the assembly 110 upwardly. If the operator then determines that the unjam sequence must be initiated, he or she presses the form feed button 202 while the printer is opened and then the operator recloses the printer. Upon reclosing of the printer, the operator again presses the form feed button 202 which signals the control system to rotate the cutter 180°. The operator then reopens the printer and now the opposite side of the rotary cutter element is exposed enabling the operator to remove a label that has wrapped around the cutter 120. Upon reclosing the printer, the control system resets the printer, then re-enabling operation of the print.

Those skilled in the art will recognize that the unjam sequence can be implemented in hardware, control software or a combination thereof. Similarly, the reverse actuation of the cutter when the "Home" position is not reached within a predetermined interval of time may also be implemented in hardware, software or both.

Although the invention has been described with a certain degree of particularity, it should be understood that those skilled in the art could make various changes to it without departing from the spirit or scope as hereinafter claimed.

We claim:

1. A printer apparatus comprising:

a) a print media supply;

b) a cutting mechanism;

c) structure defining a print media path extending from said print media supply to said cutting mechanism;

d) at least a portion of said print media path defined by a subassembly that is movable between opened and closed positions;

e) said cutting mechanism including a rotatable member and a stationary member, said rotatable member rotating relative to said stationary member to effect severing of print media located in said cutting mechanism;

f) said rotatable member carried by said movable subassembly such that when said subassembly is moved to its open position, said rotatable cutter member separates from said stationary member; and, g) alignment mechanism for maintaining operative alignment between said rotatable cutter member and said stationary cutter member when said subassembly is moved to its closed position.

2. The printing apparatus of claim 1, wherein said alignment mechanism comprises at least one key forming part of said subassembly that is engageable with a pin forming part of said stationary cutter member, the engagement between said key and said pin operative to place said stationary cutter member in an operative relationship with said rotatable cutter member.

3. The printing apparatus of claim 1, wherein said stationary member comprises a fixed blade held to a base portion of said printer by said pin, said pin engageable with a slot defined by said base portion.

4. The apparatus of claim 2, wherein said key includes an alignment slot engageable with said fixed blade pin, said alignment slot located in an orthogonal relationship with the slot formed in said base portion.

5. The apparatus of claim 4, wherein said rotatable member includes at least one alignment hub operatively engageable with said stationary member whereby said rotatable member is maintained in a predetermined spatial alignment with said stationary member whenever said subassembly is closed.

6. A printer apparatus comprising:

a) a print media supply;

b) a cutting mechanism;

c) structure defining a print media path extending from said print media supply to said cutting mechanism;

d) at least a portion of said print media path defined by a subassembly that is movable between opened and closed positions;

e) said cutting mechanism including a rotary cutter and a stationary blade, said rotary cutter rotatable relative to said stationary blade to effect severing of print media located in said cutting mechanism;

f) said rotary cutter carried by said movable subassembly such that when said subassembly is moved to its open position, said rotary cutter separates from said stationary blade; and, g) an alignment mechanism for maintaining operative alignment between said rotary cutter and said stationary blade when said subassembly is moved to its closed position.

7. A printer apparatus comprising:

a) a print media supply compartment;

b) a cutting mechanism;

c) structure defining a print media path extending from said print media supply compartment to said cutting mechanism;

d) at least a portion of said print media path defined by a subassembly that is movable between opened and closed positions;

e) said cutting mechanism including a rotatable member and a stationary member, said rotatable member rotating relative to said stationary member to effect severing of print media located in said cutting mechanism;

f) said rotatable member carried by said movable subassembly such that when said subassembly is moved to its open position, said rotatable cutter member separates from said stationary member; and, g) alignment mechanism for maintaining operative alignment between said rotatable cutter member and said stationary cutter member when said subassembly is moved to its closed position.

8. A printer apparatus comprising:

a) a print media supply compartment;

b) a cutting mechanism;

c) structure defining a print media path extending from said print media supply compartment to said cutting mechanism;

d) at least a portion of said print media path defined by a subassembly that is movable between opened and closed positions;

e) said cutting mechanism including a rotary cutter and a stationary blade, said rotary cutter rotatable relative to said stationary blade to effect severing of print media located in said cutting mechanism;

f) said rotary cutter carried by said movable subassembly such that when said subassembly is moved to its open position, said rotary cutter separates from said stationary blade; and, g) an alignment mechanism for maintaining operative alignment between said rotary cutter and said stationary blade when said subassembly is moved to its closed position.

* * * * *